US009515402B1

(12) United States Patent
Li et al.

(10) Patent No.: US 9,515,402 B1
(45) Date of Patent: Dec. 6, 2016

(54) STRUCTURES FOR EDGE-TO-EDGE COUPLING WITH FLEXIBLE CIRCUITRY

(71) Applicants: Xiang Li, Portland, OR (US); Stephen H. Hall, Forest Grove, OR (US)

(72) Inventors: Xiang Li, Portland, OR (US); Stephen H. Hall, Forest Grove, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 14/866,592

(22) Filed: Sep. 25, 2015

(51) Int. Cl.
*H01R 12/00* (2006.01)
*H01R 12/79* (2011.01)
*H01R 43/20* (2006.01)

(52) U.S. Cl.
CPC ..... *H01R 12/79* (2013.01); *H01R 43/205* (2013.01)

(58) Field of Classification Search
CPC ..... H01R 12/732
USPC ..... 439/631
See application file for complete search history.

(56) References Cited

U.S. PATENT DOCUMENTS 3,196,377 A * 7/1965 Minich ..... H01R 23/70 439/272
3,205,471 A * 9/1965 Herrmann ..... H01R 12/7082 439/136
3,482,201 A * 12/1969 Schneck ..... H01R 31/00 439/496
4,400,049 A * 8/1983 Schuck ..... H01R 12/721 439/631
4,938,701 A * 7/1990 Heberling ..... H01R 12/732 439/327
5,295,852 A * 3/1994 Renn ..... H01R 12/721 439/328
5,531,615 A * 7/1996 Irlbeck ..... H01R 12/714 439/377
5,655,922 A * 8/1997 Dux ..... H05K 7/1478 439/213
6,406,332 B1 * 6/2002 Buican ..... H01R 12/89 439/631
7,204,719 B2 * 4/2007 Kikuchi ..... H01R 12/722 439/631
7,686,619 B2 * 3/2010 Bell, Jr. ..... G06F 13/409 439/631

(Continued)

OTHER PUBLICATIONS

Hall, et al., "Flexible Circuit Structures for High-Bandwidth Commuincation", U.S. Appl. No. 14/752,639, filed Jun. 26, 2015.

*Primary Examiner* — Neil Abrams
(74) *Attorney, Agent, or Firm* — Blakely, Sokoloff, Taylor & Zafman LLP

(57) ABSTRACT

Techniques and mechanisms for coupling a flexible circuit device to another device. In an embodiment, a substrate includes a first side and a second side opposite the first side, where first contacts of a hardware interface are disposed on the first side, and second contacts of the hardware interface are disposed on the second side. First interconnects and second interconnects variously extend in the substrate, where the first contacts are coupled via the first side each to a respective one of the first interconnects, and the second contacts are coupled via the second side each to a respective one of the second interconnects. In another embodiment, the substrate is one of a flexible substrate and a printed circuit board substrate, where the first interface is configured to couple the substrate, in an edge-to-edge configuration, with the other of a flexible substrate and a printed circuit board substrate.

18 Claims, 7 Drawing Sheets

(56) References Cited

U.S. PATENT DOCUMENTS

| | | | | |
|---|---|---|---|---|
| 8,057,263 | B1 * | 11/2011 | Howard | H01R 12/721 439/631 |
| 8,465,327 | B2 * | 6/2013 | Springer | H01R 13/6471 439/631 |
| 8,550,854 | B2 * | 10/2013 | Okano | H01R 12/721 439/631 |

* cited by examiner

STRUCTURES FOR EDGE-TO-EDGE COUPLING WITH FLEXIBLE CIRCUITRY

BACKGROUND

1. Technical Field

Embodiments of the invention relate generally to flexible circuit devices and more particularly, but not exclusively, to structures for providing connection with a printed circuit board.

2. Background Art

In various laptop, ultrabook, tablet, smartphone and other designs, it is desirable to support electrical signaling across boards and/or in an otherwise thin form factor. Implementing such signal exchanges with flexible circuit technology has, to date, been constrained by a trade-off in device thickness (z-height). Traditional systems for coupling a flexible printed circuit (FPC) or a flexible flat cable (FFC) to a printed circuit board (PCB) include connector hardware that extends in a z-direction from the top (or bottom) surface of the PCB, thus requiring additional z-height thickness above that surface. Existing connectors require at least 0.8 mm in additional height above a PCB, and typically require at least 1.2 mm. Moreover, existing connectors usually employ single sided, high-density pinouts with less than 0.3 mm pitch and staggered fingers, which do not allow the use of low cost flexible flat cable (FFC) solutions.

Modern form factors for various types of electronic devices are trending toward very thin (low z-height) industrial designs. This severely limits the ability to incorporate existing flexible circuit devices such as FPCs or FFCs into the design of very thin and/or high density systems. As the functionality of successive generations of electronic devices continues to grow and as such generations continue to trend toward thinner form factors, there is expected to be an increasing value placed on incremental improvements in low profile connection systems.

BRIEF DESCRIPTION OF THE DRAWINGS

The various embodiments of the present invention are illustrated by way of example, and not by way of limitation, in the figures of the accompanying drawings and in which.

DETAILED DESCRIPTION

Figure 1:
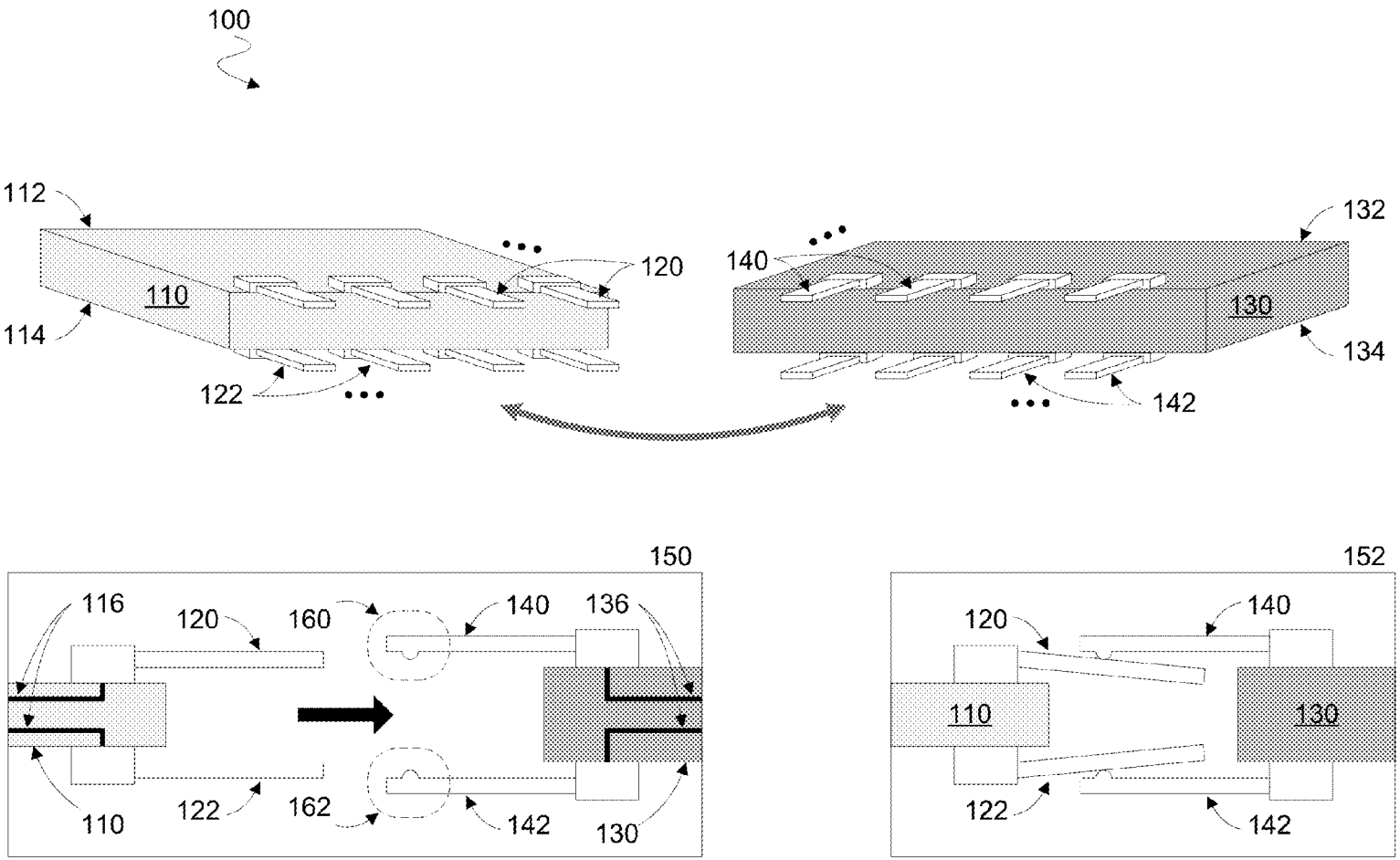
FIG. 1 is a perspective view illustrating elements of a system to provide connection by a flexible circuit device according to an embodiment.

Embodiments discussed herein variously provide techniques and mechanisms for coupling a flexible circuit device to a substrate such as that of a printed circuit board. As used herein, "flexible circuit device" refers to any of the variety of devices including a flexible substrate and circuit structures disposed in that flexible substrate. The flexible circuit device—e.g., including a FPC or a FFC—may have a hardware interface disposed at an edge of the flexible substrate, the hardware interface to enable coupling of the flexible circuit device to a rigid substrate of another device such as a printed circuit board. The hardware interface may comprise a first plurality of contact disposed on a first side of the flexible substrate, and a second plurality of contacts disposed on a second side of the substrate (opposite the first side). The other device may comprise another hardware interface for coupling to the flexible circuit device, the other hardware interface similarly including contacts variously disposed on opposite sides of the rigid substrate. The two interfaces may be configured to enable edge-to-edge coupling of the flexible circuit device to the rigid substrate, resulting in a connection that is low profile, as compared to that provided by existing solutions.

Certain embodiments variously provide flexibility in the design of very thin devices without significantly impacting performance or bill-of-material (BOM) costs. By providing a connector that is oriented along a midline extending along a substrate (the connector including contacts on opposite sides of the substrate) some embodiments enable connections having a z-height of 0.2 mm or even less. Alternatively or in addition, such embodiments may enable an increased pin count for a given width of a connector. For example, due to double side contacts, a pitch of such a connector may be reduced—e.g., from 0.2 mm to 0.4 mm pitch. This in turn may allow relatively low-cost FFC cables to be used without sacrificing signal integrity, power delivery or electromagnetic interference (EMI) performance. FFCs are generally associated with relatively low cable loss, and thus better signal integrity performance. Alternatively or in addition, some embodiments may allow an increase (e.g., a doubling) of routing density for conventional FPC cables, which may allow fewer distinct connectors to be used. Accordingly, these solutions—in addition to providing improved z-height—variously allow for reduced BOM cost, good signal characteristics and/or improved PCB space utilization.

The technologies described herein may be implemented in one or more electronic devices. Non-limiting examples of electronic devices that may utilize the technologies described herein include any kind of mobile device and/or stationary device, such as cameras, cell phones, computer terminals, desktop computers, electronic readers, facsimile machines, kiosks, netbook computers, notebook computers, internet devices, payment terminals, personal digital assistants, media players and/or recorders, servers (e.g., blade server, rack mount server, combinations thereof, etc.), set-top boxes, smart phones, tablet personal computers, ultra-mobile personal computers, wired telephones, combinations thereof, and the like. Such devices may be portable or stationary. In some embodiments the technologies described herein may be employed in a desktop computer, laptop computer, smart phone, tablet computer, netbook computer, notebook computer, personal digital assistant, server, combinations thereof, and the like. More generally, the technologies described herein may be employed in any of a variety of electronic devices including one or more packaged IC devices.

FIG. 1 illustrates elements of a system 100 to provide coupling between a flexible circuit device and a rigid substrate of another device (such as a PCB) according to an embodiment. System 100 may include a processing-capable platform or may provide for operation as a component of such a platform.

In the embodiment shown, system 100 includes a flexible circuit device 110 and a PCB 130, where respective hardware interface structures of flexible circuit device 110 and PCB 130 are configured to couple to one another. Embodiments may be variously provided, for example, by system 100 as a whole, by flexible circuit device 110 alone or by PCB 110 alone.

For either printed circuit device 110 or PCB 130, a hardware interface of the device may include contacts (e.g., including pins, pads, bumps and/or other conductive connection structures) variously disposed on opposite sides of a substrate. For example, a flexible substrate of flexible circuit device 110 may have a side 112 and another side 114 that is opposite side 112, where the hardware interface of flexible circuit device 110 includes contacts 120 disposed on side 112, as well as other contacts 122 disposed on side 114. Alternatively or in addition, a rigid substrate of PCB 130 may have a side 132 and another side 134 that is opposite side 132, where the hardware interface of PCB 130 includes contacts 140 disposed on side 132, as well as other contacts 142 disposed on inside 134. The respective substrate materials of flexible circuit device 110 and PCB 130 may include any of a variety of materials used in conventional printed circuit board and/or flexible printed circuits manufacturing techniques, and may not be limiting on some embodiments.

Cross-sectional detail views 150, 152 of FIG. 1 illustrate coupling of flexible circuit device 110 to PCB 130 according to an example of the embodiment. As shown in view 150, contacts 120, 122 may each be coupled to a respective one of interconnects 116 variously extending in the flexible substrate of flexible circuit device 110. Similarly, contacts 140, 142 may be coupled each to a respective one of interconnects 136 variously extending in the substrate of PCB 130. Interconnects 116, 136 may each comprise any of the variety of combinations of one or more vias, traces and or other conductive structures that, for example, are to exchange data, address information, control information, clock signals, a supply voltage, a reference potential (e.g., a ground) and/or the like. For example, such interconnects 116, 136 may variously extend to further couple directly or indirectly to respective other circuitry (not shown) that is included in, or is to couple to, system 100. Certain embodiments are not limited with respect to the particular number and/or type of signals, voltage, etc. variously exchanged between interconnects 116, 136 via contacts 120, 122, 140, 142.

As shown in detail view 152, coupling of flexible circuit device 110 to PCB 130 may include coupling contacts 120, 122 each to the respective one of contacts 140, 142. Such coupling may cause some or all contacts to variously deflect or otherwise change position. For example, the coupling represented in detail view 152 may cause contacts 120 and contacts 122 to move in opposite directions—e.g., where contacts 120, 122 move toward one another. Alternatively or in addition, hardware interface contacts may be variously deflected in the respective directions away from each other—e.g., where contacts 140, 142 are pushed apart from one another by insertion of contacts 120, 122. In one embodiment, deflection, deformation and/or other movement of contacts may result in pressure that provides for improved coupling between printed circuit device 110 and PCB 130. For example, contacts 140, 142 may have formed thereon respective structures 160, 162 which apply pressure to, and provide for improved electrical connection with, the deflected contacts 120, 122.

The particular type, number and arrangement of contacts 120, 122, 140, 142 are merely illustrative, and may not be limiting on certain embodiments. By way of illustration and not a limitation, contacts 120, 122 are shown in FIG. 1 as extending past an edge of the flexible substrate of flexible circuit device 110. Similarly, contacts 140, 142 are shown as extending past an edge of the rigid substrate of PCB 130. However, certain embodiments are not limited in this regard, and other embodiments may variously include (for example) contacts comprising a pad or pads disposed on a (rigid or flexible) substrate, where such pad or pads do not extend past an edge of that substrate.

Figure 2:
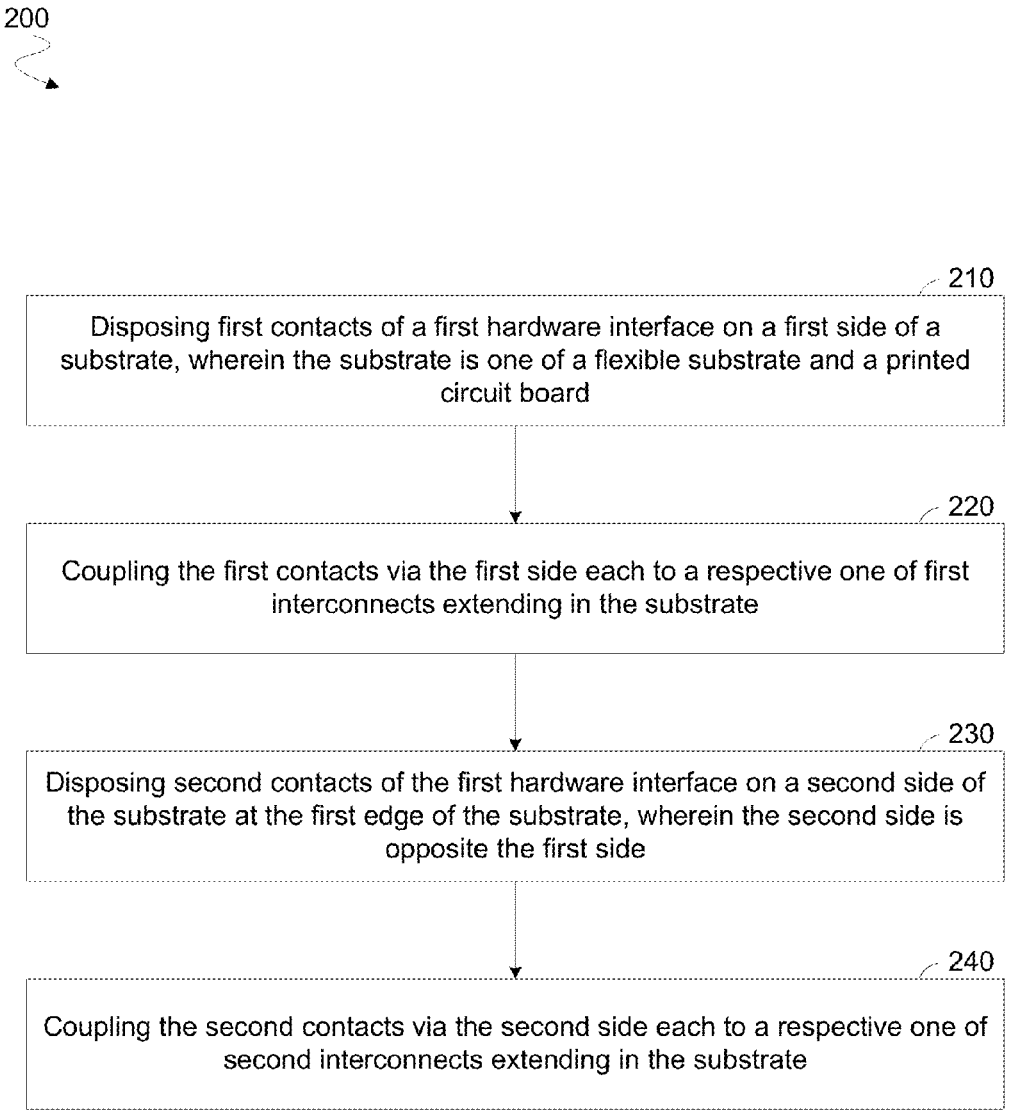
FIG. 2 is a flow diagram illustrating elements of a method for fabricating interface hardware of a circuit device according to an embodiment.

FIG. 2 illustrates elements of a method 200 for fabricating a device to support edge-to-edge connection according to an embodiment. Method 200 may produce a device having some or all of the features of flexible circuit device 110, for example. Alternatively or in addition, method 200 may produce a device including features of PCB 130.

Method 200 may comprise, at 210, disposing first contacts of a first hardware interface on a first side of a substrate, wherein the substrate is one of a flexible substrate and a printed circuit board. In an embodiment, the first hardware interface fabricated by method 200 is to enable coupling of the substrate to another hardware interface disposed on another device—e.g., where the other device is the other of the flexible substrate and the printed circuit board. The disposing at 210 may include positioning the first contacts at least partially over the first side—e.g., where the first contacts also partially extend past an edge of the first side.

In an embodiment, method 200 further includes, at 220, coupling the first contacts via the first side each to a respective one of first interconnects extending in the substrate. For example, the first interconnects may variously enable coupling of the first contacts to other circuitry that is in the substrate, to other circuitry that is to be coupled on the substrate, and/or to another hardware interface for additional coupling of substrate. The coupling at 220 may include operations adapted from any of a variety of conventional soldering or other techniques for connecting pins, pads, balls, bumps or other conductive structures on a rigid substrate and/or on a flexible substrate.

Method may further comprise, at 230, disposing second contacts of the first hardware interface on a second side of the substrate, wherein the second side is opposite the first side. Although certain embodiments are not limited in this regard, the disposing at 230 may include, for example, positioning the second contacts each to align vertically with a respective one of the first contacts. Alternatively or in addition, the second contacts may extend at least partially past an edge of the second side, in some embodiments. In one embodiment, respective portions of the first contacts extend past the edge of the first side and through a plane in which the first side extends. Alternatively or in addition, respective portions of the second contacts may extend past the edge of the second side and through a plane in which the second side extends. Accordingly, in a region where the substrate does not extend, the first contacts and the second contacts may be separated by a distance that is less than a distance between the first side and the second side. In some embodiments, method 200 also includes, at 240, coupling the second contacts via the second side each to a respective one of second interconnects extending in the substrate. The coupling at 240 may include operations similar to those performed for the coupling at 220, for example.

Although certain embodiments are not limited in this regard, other operations (not shown) of method 200—or alternatively, a repetition of method 200—may form another hardware interface of the substrate. By way of illustration and not limitation, the first interface may be formed at a first end of the substrate—e.g., where the substrate is a flexible substrate including a second end. In such an embodiment, additional processing may form a second hardware interface at the second end of the flexible substrate, the second hardware interface including respective contacts variously disposed on the first side and the second side. The second interface may variously couple to the first interconnects and second interconnects—e.g., where method 200 fabricates a FFC or other such connector device.

Figure 3:
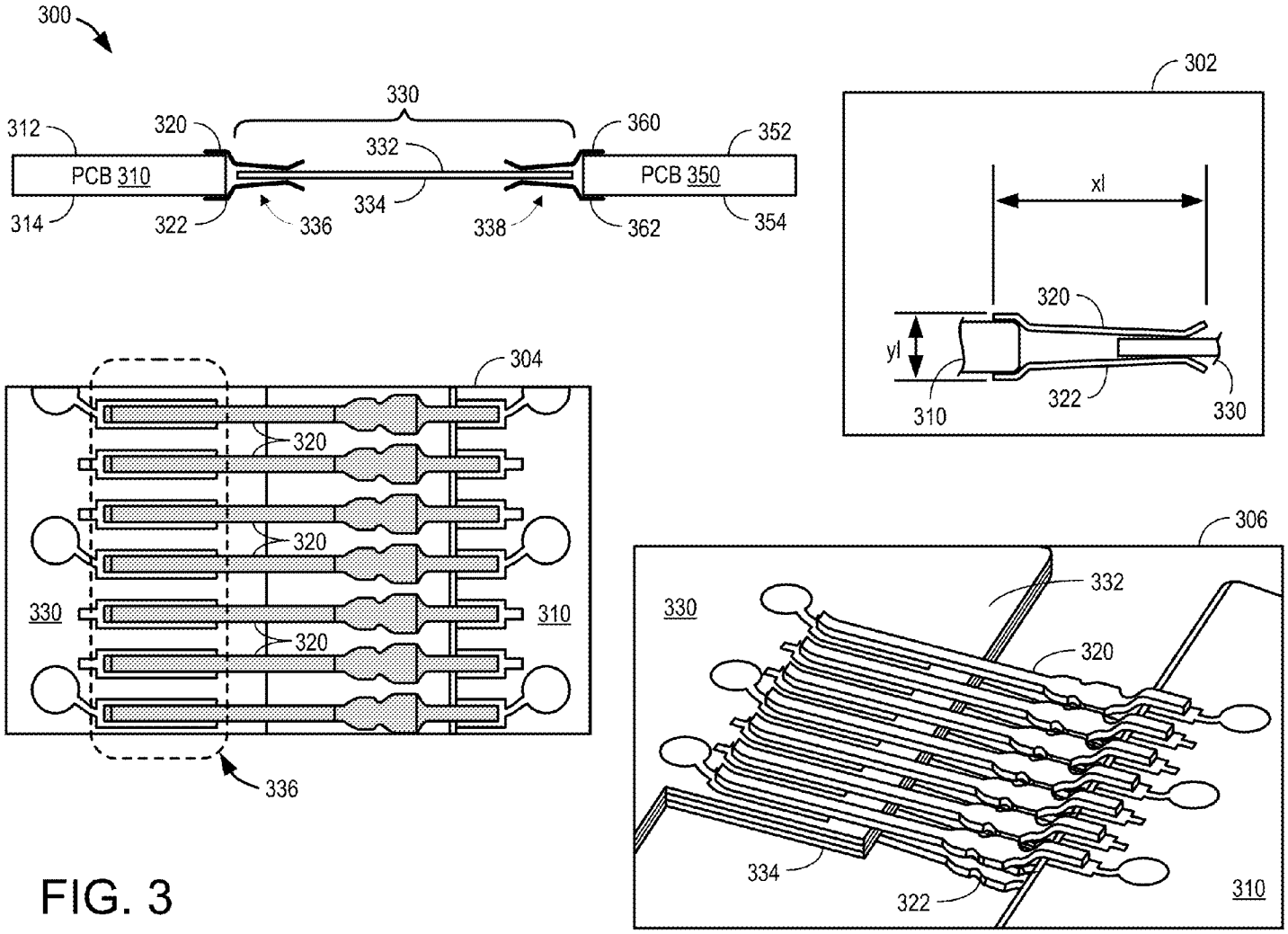
FIG. 3 shows various perspective views of a system to provide connection by a flexible circuit device according to an embodiment.

FIG. 3 shows various views of a system 300 to provide edge-to-edge coupling with a flexible circuit device according to an embodiment. System 300 may include some or all of the features of system 100, for example. In FIG. 3, system 300 includes PCBs 310, 350 and a flexible circuit device 330 that is configured for edge-wise coupling with one or each of PCBs 310, 350. One of more of PCBs 310, 350 and flexible circuit device 330 may be made, for example, according to techniques such as those of method 200.

In an embodiment, a hardware interface of PCB 310 includes both contacts 320 disposed on a side 312 of PCB 310 and contacts 322 on an opposite side 314 of PCB 310. Similarly, a hardware interface of PCB 350 may include both contacts 360 disposed on a side 352 of PCB 350 and contacts 362 on an opposite side 354 of PCB 350. The hardware interface of PCB 310 may couple to a corresponding hardware interface 336 at one end of flexible circuit device 330—e.g., where the hardware interface 336 includes conductive pads (and/or other contacts) variously disposed on opposite sides 332, 334 of a flexible substrate. Alternatively or in addition, the hardware interface of PCB 350 may couple to a corresponding hardware interface 338 at an opposite end of flexible circuit device 330—e.g., where the hardware interface 338 includes conductive pads variously disposed on sides 332, 334.

Cross-sectional view 302 illustrates details of an edge-to-edge connection with system 300 according to one example embodiment. As shown in cross-sectional view 302, contacts 320, 322 may extend past respective edges of sides 312, 314—e.g., wherein a closest distance between contacts 320, 322 is less then a distance between sides 312, 314. By providing an interface that is oriented in parallel with sides 312, 314—e.g., the interface aligned with a midline plane between sides 312, 314—some embodiments enable an edge-to-edge connection having a height (represented by the label y1) of as little as 1.3 mm, or even less. The illustrative length x1 of contacts 320, 322 shown in view 302 may be in a range of 4 mm to 7 mm, although certain embodiments are not limited in this regard.

Top view 304 and perspective view 306 illustrate details of an edge-to-edge connection with system 300 according to another example embodiment. As shown in views 304, 306, contacts 320 may couple at side 332 to respective conductive pads of hardware interface 336, and contacts 322 each couple at side 334 to other respective conductive pads of hardware interface 336. In an embodiment, the thickness of flexible circuit device 330 may result in contacts 320 being displaced in one direction, and contacts 322 being displaced in an opposite direction. As a result, contacts 320, 322 may apply pressure against one another via respective sides 332, 334. Such pressure may provide physical resistance to reduce the chance of flexible circuit device 330 decoupling from PCB 310. Alternatively or in addition, such pressure may provide for improved electrical coupling of contacts 320, 322 to respective pads of hardware interface 336.

Figure 4:
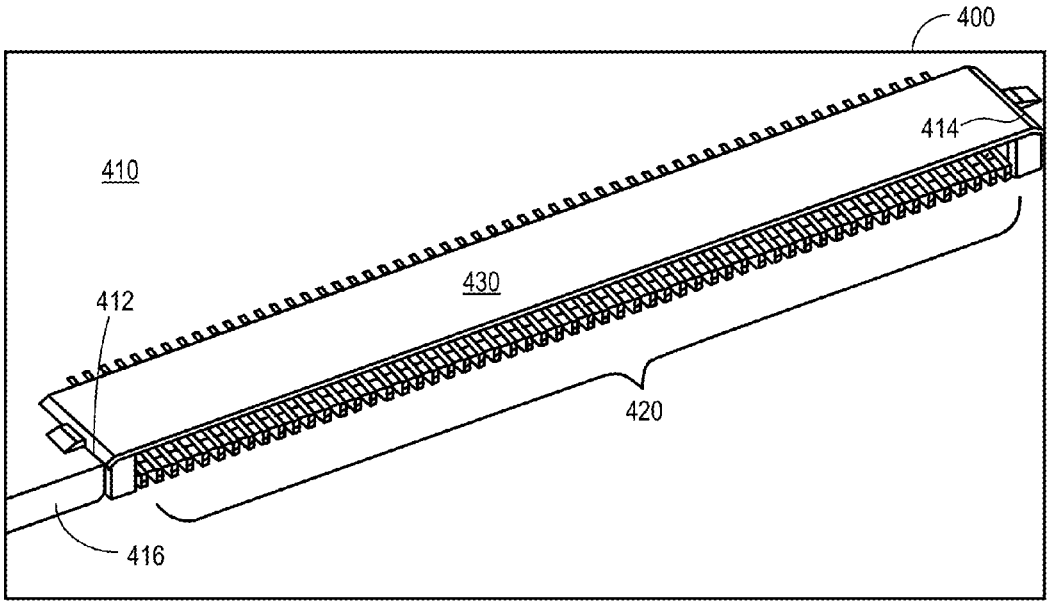
FIG. 4 shows various perspective views of a system to provide connection by a flexible circuit device according to an embodiment.
Figure 4:
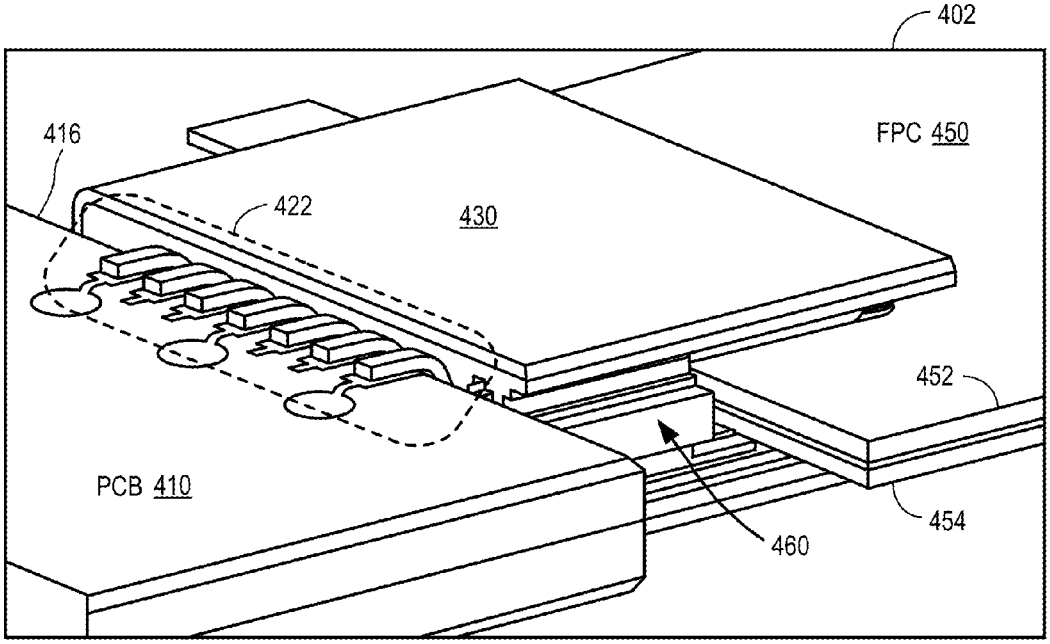

FIG. 4 shows various views 400, 402 of a system to provide edge-to-edge coupling. The system represented in views 400, 402—which may include some or all of the features of one of systems 100, 300, for example—includes PCB 410 and a flexible printed circuit FPC 450 that is configured for edge-wise coupling with PCB 410. One of both of PCB 410 and FPC 450 may be fabricated by processing such as that of method 200, for example.

As shown in detail view 400, a substrate of PCB 410 may form a sidewall 416 extending between opposite sides of the substrate, where a hardware interface 420 of PCB 410 includes contacts variously disposed on such opposite sides. Hardware interface 420 may include contacts coupled to a data bus, a command/address bus, a supply voltage interconnect, a reference voltage interconnect and/or any of a variety of other conductive structures (not shown) that extend in the substrate of PCB 410.

In an embodiment, sidewall 416 forms a recess including opposing sidewall portions 412, 414 between which the hardware interface 420 extends. The recess may aid protecting contacts of interface 420 from physical damage. Alternatively or in addition, such protection may be aided by a shield structure 430 that, for example, is coupled to the substrate and forms at least part of a connector housing. By way of illustration and not limitation, shield structure 430 may include polybutylene terephthalate (PBT) polyethylene terephthalate (PET) or any of a variety plastic and/or other materials used in conventional connector housing structures.

View 402 shows PCB 410 coupled to FPC 45 via hardware interface 420. As shown in view 402, hardware interface 420 includes contacts 422 that variously extend from one side of PCB 410 to couple each to a respective one of contacts (not shown) that are disposed on a side 452 of FPC 450. Other contacts (not shown) of hardware interface 420 may extend from an opposite side of PCB 410 to couple each to a respective one of other contacts (not shown) that are disposed on a side 454 of FPC 450 that is opposite side 452. In the embodiment represented in view 402, shield structure 430 includes alignment structures 460 that aid in the coupling of interface contacts to one another. Alternatively or in addition, shield structure 430 may include materials and/or structures (not shown) to aid in mitigating electromagnetic interference in signals exchanged via interface 420. Shield structure 430 and/or other connector housing structures coupled to PCB 410 may include any of a variety of one or more latches, clasps and/or other locking mechanisms (not shown) to secure the coupling of PCB 410 to FP 450. Such one or more locking mechanisms may include structures adapted from conventional techniques for secure coupling between connector hardware.

Figure 5:
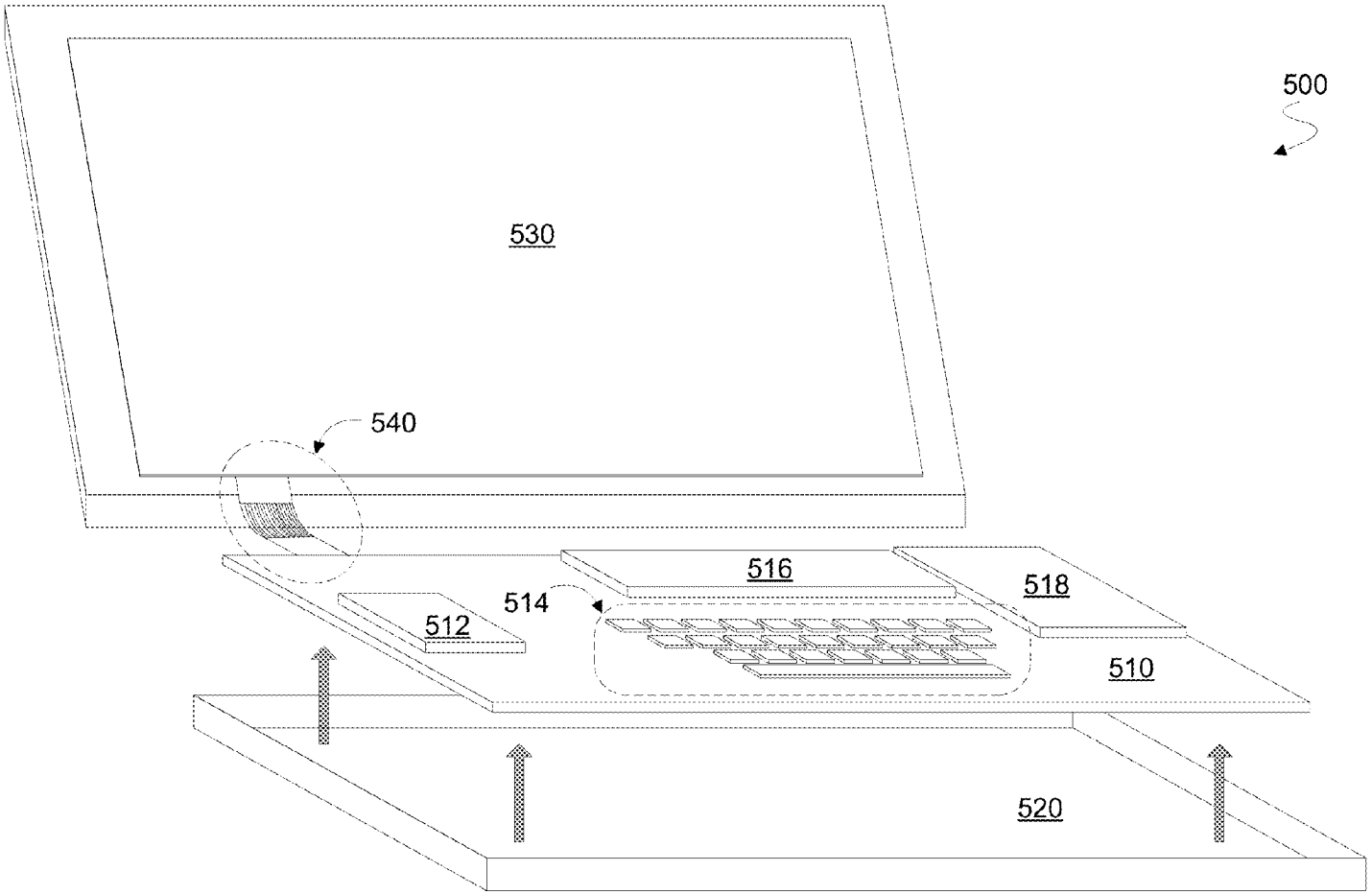
FIG. 5 is an exploded view of a system including flexible circuit structures according to an embodiment.

FIG. 5 shows an exploded view of a system 500 including flexible circuit structures to exchange signaling—e.g., conforming to the Embedded Display Port (eDP) standard, Version 1.0 of the Video Electronics Standards Association (VESA), adopted December 2008—across a hinge according to an embodiment. System 500 may include hardware of any of a variety of computing-capable platforms including, but not limited to, a mobile device (e.g., a smart phone, palmtop, personal digital assistant, etc.), laptop computer, desktop computer, wearable device and/or the like.

System 500 is one example of hardware that includes at least two portions that may be variously articulated relative to one another by a hinge mechanism, where circuitry of the two portions are to exchange signaling via a flexible circuit that bends with movement of the hinge mechanism. By way of illustration and not limitation, system 500 may include a housing 520 coupled via a hinge mechanism (not shown) to a display 530. Housing 520 may have disposed therein first signaling resources—as represented by the illustrative motherboard 510 and circuit resources 512, 514, 516, 518 coupled thereto. Resources 512, 516 518 represent any of a wide variety of packaged integrated circuit (and/or other) devices, including, for example, random access memory, read-only memory, one or more processors, a memory controller, a wired or wireless network interface and/or the like. Resource 514 represents keyboard circuitry and/or any of a wide variety of other input/output mechanisms such as a mouse, touchpad, touchscreen, speaker, microphone, etc. Circuit resources 512, 514, 516, 518 may operate for motherboard 510 to exchange signals, via a flexible circuit 540, with another portion of system 500 (such as the illustrative display 530). Display 530 may include circuitry to exchange video, touch, audio and/or other information with motherboard 510 (and/or resources coupled thereto). In an embodiment, interface structures of flexible circuit 540 may enable coupling in an edge-to-edge configuration between flexible circuit 540 and motherboard 510 or with a substrate of display 530.

Figure 6:
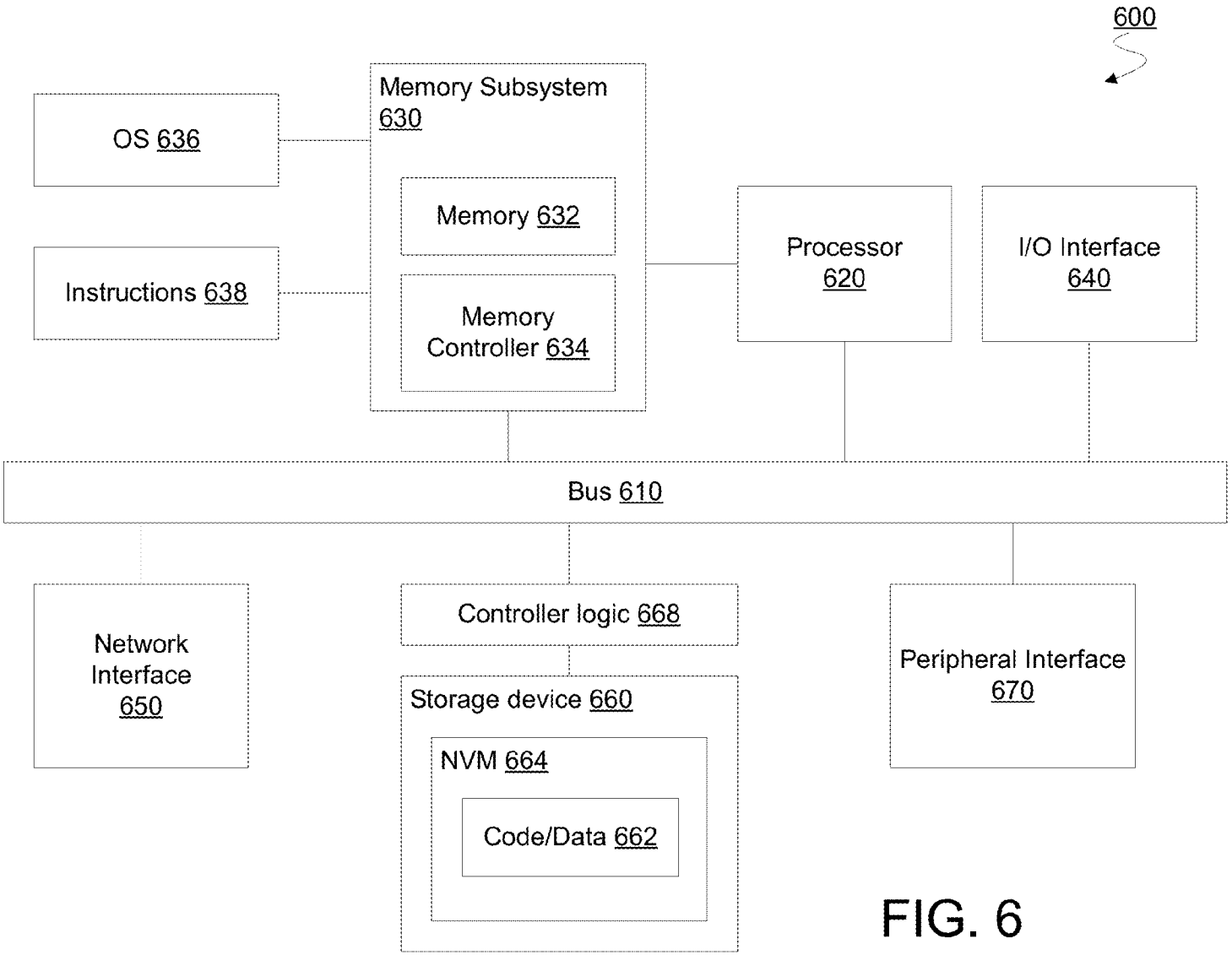
FIG. 6 is a functional block diagram illustrating elements of a computing system including flexible circuit structures according to an embodiment.

FIG. 6 is a block diagram of an embodiment of a computing system (e.g., including features of system 700) in which an edge-wise connection with a flexible circuit device may be implemented. System 600 represents a computing device in accordance with any embodiment described herein, and may be a laptop computer, a desktop computer, a server, a gaming or entertainment control system, a scanner, copier, printer, or other electronic device. System 600 may include processor 620, which provides processing, operation management, and execution of instructions for system 600. Processor 620 may include any type of microprocessor, central processing unit (CPU), processing core, or other processing hardware to provide processing for system 600. Processor 620 controls the overall operation of system 600, and may be or include, one or more programmable general-purpose or special-purpose microprocessors, digital signal processors (DSPs), programmable controllers, application specific integrated circuits (ASICs), programmable logic devices (PLDs), or the like, or a combination of such devices.

Memory subsystem 630 represents the main memory of system 600, and provides temporary storage for code to be executed by processor 620, or data values to be used in executing a routine. Memory subsystem 630 may include one or more memory devices such as read-only memory (ROM), flash memory, one or more varieties of random access memory (RAM), or other memory devices, or a combination of such devices. Memory subsystem 630 stores and hosts, among other things, operating system (OS) 636 to provide a software platform for execution of instructions in system 600. Additionally, other instructions 638 are stored and executed from memory subsystem 630 to provide the logic and the processing of system 600. OS 636 and instructions 638 are executed by processor 620.

Storage device 660 may be or include any conventional nonvolatile medium (NVM) 664 for storing large amounts of data in a nonvolatile manner, such as one or more magnetic, solid state, or optical based disks, or a combination. NVM 664 may store code or instructions and data 662 in a persistent state (i.e., the value is retained despite interruption of power to system 600). Access to NVM 664 may be provided with controller logic 668 coupled to (or in some embodiments, included in) storage device 660. For example, controller logic 668 or may be any of the variety of host controller logic to exchange data frames to access NVM 664. Storage device 660 may be generically considered to be a "memory," although memory 630 is the executing or operating memory to provide instructions to processor 620. Whereas storage 660 is nonvolatile, memory 630 may include volatile memory (i.e., the value or state of the data is indeterminate if power is interrupted to system 600).

Memory subsystem 630 may include memory device 632 where it stores data, instructions, programs, or other items. In one embodiment, memory subsystem 630 includes memory controller 634 to provide access to memory 632—e.g., on behalf of processor 620.

Processor 620 and memory subsystem 630 are coupled to bus/bus system 610. Bus 610 is an abstraction that represents any one or more separate physical buses, communication lines/interfaces, and/or point-to-point connections, connected by appropriate bridges, adapters, and/or controllers. Therefore, bus 610 may include, for example, one or more of a system bus, a Peripheral Component Interconnect (PCI) bus, an Open Core Protocol (OCP) bus, a HyperTransport or industry standard architecture (ISA) bus, a small computer system interface (SCSI) bus, a universal serial bus (USB), or an Institute of Electrical and Electronics Engineers (IEEE) standard 1394 bus (commonly referred to as "Firewire"). The buses of bus 610 may also correspond to interfaces in network interface 650.

System 600 may also include one or more input/output (I/O) interface(s) 640, network interface 650, one or more internal mass storage device(s) 660, and peripheral interface 670 coupled to bus 610. I/O interface 640 may include one or more interface components through which a user interacts with system 600 (e.g., video, audio, and/or alphanumeric interfacing). Network interface 650 provides system 600 the ability to communicate with remote devices (e.g., servers, other computing devices) over one or more networks. Network interface 650 may include an Ethernet adapter, wireless interconnection components, USB (universal serial bus), or other wired or wireless standards-based or proprietary interfaces.

Peripheral interface 670 may include any hardware interface not specifically mentioned above. Peripherals refer generally to devices that connect dependently to system 600. A dependent connection is one where system 600 provides the software and/or hardware platform on which operation executes, and with which a user interacts.

Figure 7:
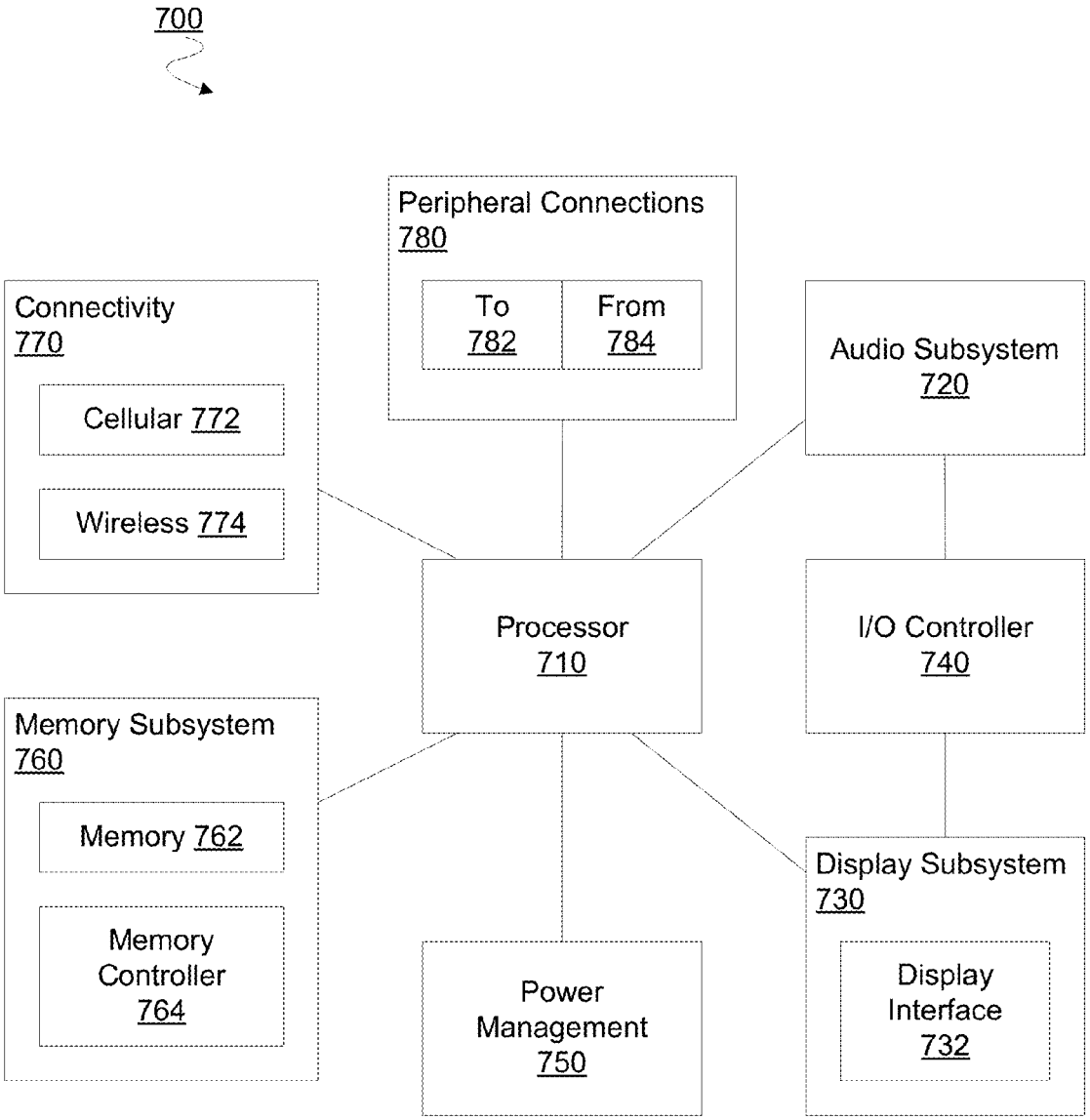
FIG. 7 is a functional block diagram illustrating elements of a mobile device including flexible circuit structures according to an embodiment.

FIG. 7 is a block diagram of an embodiment of a mobile device (e.g., including features of system 700) in which an edge-wise connection with a flexible circuit device may be implemented. Device 700 represents a mobile computing device, such as a computing tablet, a mobile phone or smartphone, a wireless-enabled e-reader, or other mobile device. It will be understood that certain of the components are shown generally, and not all components of such a device are shown in device 700.

Device 700 may include processor 710, which performs the primary processing operations of device 700. Processor 710 may include one or more physical devices, such as microprocessors, application processors, microcontrollers, programmable logic devices, or other processing means. The processing operations performed by processor 710 include the execution of an operating platform or operating system on which applications and/or device functions are executed. The processing operations include operations related to I/O (input/output) with a human user or with other devices, operations related to power management, and/or operations related to connecting device 700 to another device. The processing operations may also include operations related to audio I/O and/or display I/O.

In one embodiment, device 700 includes audio subsystem 720, which represents hardware (e.g., audio hardware and audio circuits) and software (e.g., drivers, codecs) components associated with providing audio functions to the computing device. Audio functions may include speaker and/or headphone output, as well as microphone input. Devices for such functions may be integrated into device 700, or connected to device 700. In one embodiment, a user interacts with device 700 by providing audio commands that are received and processed by processor 710.

Display subsystem 730 represents hardware (e.g., display devices) and software (e.g., drivers) components that provide a visual and/or tactile display for a user to interact with the computing device. Display subsystem 730 may include display interface 732, which may include the particular screen or hardware device used to provide a display to a user. In one embodiment, display interface 732 includes logic separate from processor 710 to perform at least some processing related to the display. In one embodiment, display subsystem 730 includes a touchscreen device that provides both output and input to a user.

I/O controller 740 represents hardware devices and software components related to interaction with a user. I/O controller 740 may operate to manage hardware that is part of audio subsystem 720 and/or display subsystem 730. Additionally, I/O controller 740 illustrates a connection point for additional devices that connect to device 700 through which a user might interact with the system. For example, devices that may be attached to device 700 might include microphone devices, speaker or stereo systems, video systems or other display device, keyboard or keypad devices, or other I/O devices for use with specific applications such as card readers or other devices.

As mentioned above, I/O controller 740 may interact with audio subsystem 720 and/or display subsystem 730. For example, input through a microphone or other audio device may provide input or commands for one or more applications or functions of device 700. Additionally, audio output may be provided instead of or in addition to display output. In another example, if display subsystem includes a touchscreen, the display device also acts as an input device, which may be at least partially managed by I/O controller 740. There may also be additional buttons or switches on device 700 to provide I/O functions managed by I/O controller 740.

In one embodiment, I/O controller 740 manages devices such as accelerometers, cameras, light sensors or other environmental sensors, gyroscopes, global positioning system (GPS), or other hardware that may be included in device 700. The input may be part of direct user interaction, as well as providing environmental input to the system to influence its operations (such as filtering for noise, adjusting displays for brightness detection, applying a flash for a camera, or other features).

In one embodiment, device 700 includes power management 750 that manages battery power usage, charging of the battery, and features related to power saving operation. Memory subsystem 760 may include memory device(s) 762 for storing information in device 700. Memory subsystem 760 may include nonvolatile (state does not change if power to the memory device is interrupted) and/or volatile (state is indeterminate if power to the memory device is interrupted) memory devices. Memory 760 may store application data, user data, music, photos, documents, or other data, as well as system data (whether long-term or temporary) related to the execution of the applications and functions of system 700.

In one embodiment, memory subsystem 760 includes memory controller 764 (which could also be considered part of the control of system 700, and could potentially be considered part of processor 710). Connectivity 770 may include hardware devices (e.g., wireless and/or wired connectors and communication hardware) and software components (e.g., drivers, protocol stacks) to enable device 700 to communicate with external devices. The device could be separate devices, such as other computing devices, wireless access points or base stations, as well as peripherals such as headsets, printers, or other devices.

Connectivity 770 may include multiple different types of connectivity. To generalize, device 700 is illustrated with cellular connectivity 772 and wireless connectivity 774. Cellular connectivity 772 refers generally to cellular network connectivity provided by wireless carriers, such as provided via GSM (global system for mobile communications) or variations or derivatives, CDMA (code division multiple access) or variations or derivatives, TDM (time division multiplexing) or variations or derivatives, LTE (long term evolution—also referred to as "4G"), or other cellular service standards. Wireless connectivity 774 refers to wireless connectivity that is not cellular, and may include personal area networks (such as Bluetooth), local area networks (such as WiFi), and/or wide area networks (such as WiMax), or other wireless communication. Wireless communication refers to transfer of data through the use of modulated electromagnetic radiation through a non-solid medium. Wired communication occurs through a solid communication medium.

Peripheral connections 780 include hardware interfaces and connectors, as well as software components (e.g., drivers, protocol stacks) to make peripheral connections. It will be understood that device 700 could both be a peripheral device ("to" 782) to other computing devices, as well as have peripheral devices ("from" 784) connected to it. Device 700 commonly has a "docking" connector to connect to other computing devices for purposes such as managing (e.g., downloading and/or uploading, changing, synchronizing) content on device 700. Additionally, a docking connector may allow device 700 to connect to certain peripherals that allow device 700 to control content output, for example, to audiovisual or other systems.

In addition to a proprietary docking connector or other proprietary connection hardware, device 700 may make peripheral connections 780 via common or standards-based connectors. Common types may include a Universal Serial Bus (USB) connector (which may include any of a number of different hardware interfaces), DisplayPort including MiniDisplayPort (MDP), High Definition Multimedia Interface (HDMI), Firewire, or other type.

In one implementation, a device comprises a substrate having disposed therein first interconnects and second interconnects, wherein the substrate is one of a flexible substrate and a printed circuit board. The device further comprises a first hardware interface including first contacts disposed on a first side of the substrate, the first contacts each coupled via the first side to a respective one of the first interconnects, and second contacts disposed on a second side of the substrate, the second side opposite the first side, the second contacts each coupled via the second side to a respective one of the second interconnects, wherein the first hardware interface is configured to couple the substrate to another hardware interface disposed on another of the flexible substrate and the printed circuit board.

In an embodiment, the first contacts extend past an edge of the first side, and the second contacts extend past an edge of the second side. In another embodiment, the substrate is the flexible substrate including a first end and a second end, the first hardware interface disposed that the first end, and the device further comprises a second hardware interface coupled at the second end, the second hardware interface including third contacts disposed on the first side of the substrate, and fourth contacts disposed on the second side of the substrate. In another embodiment, the third contacts are each coupled via the first side to a respective one of the first interconnects, wherein the second contacts are each coupled via the second side to a respective one of the second interconnects.

In another embodiment, the device is a flexible flat cable. In another embodiment, the first hardware interface further comprises a shield structure extending across first contacts. In another embodiment, the shield structure includes an alignment structure to receive a contact of the other hardware interface. In another embodiment, the first side and the second side form a recess, wherein the first hardware interface is disposed in the recess. In another embodiment, while the substrate is coupled to the other hardware interface, the first contacts are to impart a pressure in a first direction and the second contact are to impart a pressure in a second direction opposite to the first direction.

In another implementation, a method comprises disposing first contacts of a first hardware interface on a first side of a substrate, wherein the substrate is one of a flexible substrate and a printed circuit board, coupling the first contacts via the first side each to a respective one of first interconnects extending in the substrate, disposing second contacts of the first hardware interface on a second side of the substrate, wherein the second side is opposite the first side, and coupling the second contacts via the second side each to a respective one of second interconnects extending in the substrate, wherein the first hardware interface is configured to enable coupling of the substrate to another hardware interface disposed on another of the flexible substrate and the printed circuit board.

In another embodiment, the method further comprises positioning respective ends of the first contacts each to extend past the edge of the first side, and positioning respective ends of the second contacts each to extend past the edge of the second side. In another embodiment, the substrate is a flexible substrate including a first end and a second end, wherein the disposing the first contacts on the first side includes disposing the first contacts at the first end, wherein the disposing the second contacts on the second side includes disposing the second contacts at the first end, the method further comprises disposing third contacts of a second hardware interface on the first side, and disposing fourth contacts of the second hardware interface on the second side. In another embodiment, the method further comprises coupling the third contacts via the first side each to a respective one of the first interconnects, and coupling the fourth contacts via the second side each to a respective one of the second interconnects. In another embodiment, the device is a flexible flat cable. In another embodiment, the method further comprises coupling a shield structure to the substrate, the shield structure extending across first contacts. In another embodiment, the first side and the second side form a recess, and wherein disposing the first contacts includes disposing the first contacts in the recess.

In another implementation, a system comprises a flexible circuit device including a substrate having disposed therein first interconnects and second interconnects, wherein the substrate is one of a flexible substrate and a printed circuit board, and a first hardware interface including first contacts disposed on a first side of the substrate, the first contacts each coupled via the first side to a respective one of the first interconnects, and second contacts disposed on a second side of the substrate, the second side opposite the first side, the second contacts each coupled via the second side to a respective one of the second interconnects. The system further comprises a first printed circuit board (PCB) including a second hardware interface coupled to the flexible circuit device via the first hardware interface.

In another embodiment, the first hardware interface is disposed that a first end of the flexible circuit device, wherein the flexible circuit device further comprises a third hardware interface coupled at a second end of the flexible circuit device, the third hardware interface including third contacts disposed on the first side of the substrate, and fourth contacts disposed on the second side of the substrate. In another embodiment, the system further comprises a second PCB including a fourth hardware interface coupled to the flexible circuit device via the third hardware interface. In another embodiment, the first contacts extend past an edge of the first side, and the second contacts extend past an edge of the second side. In another embodiment, the flexible circuit device is a flexible flat cable.

Techniques and architectures for providing interconnection with a flexible circuit device are described herein. In the above description, for purposes of explanation, numerous specific details are set forth in order to provide a thorough understanding of certain embodiments. It will be apparent, however, to one skilled in the art that certain embodiments can be practiced without these specific details. In other instances, structures and devices are shown in block diagram form in order to avoid obscuring the description.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

Some portions of the detailed description herein are presented in terms of algorithms and symbolic representations of operations on data bits within a computer memory. These algorithmic descriptions and representations are the means used by those skilled in the computing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the discussion herein, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Certain embodiments also relate to apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs) such as dynamic RAM (DRAM), EPROMs, EEPROMs, magnetic or optical cards, or any type of media suitable for storing electronic instructions, and coupled to a computer system bus.

The algorithms and displays presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description herein. In addition, certain embodiments are not described with reference to any particular programming language. It will be appreciated that a variety of programming languages may be used to implement the teachings of such embodiments as described herein.

Besides what is described herein, various modifications may be made to the disclosed embodiments and implementations thereof without departing from their scope. Therefore, the illustrations and examples herein should be construed in an illustrative, and not a restrictive sense. The scope of the invention should be measured solely by reference to the claims that follow.

What is claimed is:

1. A device comprising:

a substrate having disposed therein first interconnects and second interconnects, wherein the substrate is one of a flexible substrate and a printed circuit board; and a first hardware interface including:

first contacts disposed on a first side of the substrate, the first contacts each coupled via a corresponding solder joint at the first side to a respective one of the first interconnects, wherein the first contacts each extend past an edge of the first side and wherein, for each of the first contacts, any region of the contact by which the contact is secured to the substrate is a region disposed on the first side; and second contacts disposed on a second side of the substrate, the second side opposite the first side, the second contacts each coupled via a corresponding solder joint at the second side to a respective one of the second interconnects, wherein the second contacts each extend past an edge of the second side and wherein, for each of the second contacts, any region of the contact by which the contact is secured to the substrate is a region disposed on the second side;

wherein the first hardware interface is configured to couple the substrate to another hardware interface.

2. The device of claim 1, wherein, for each of the first contacts, the contact is coupled to the first side only via the corresponding solder joint, wherein for each of the second contacts, the contact is coupled to the second side only via the corresponding solder joint.

3. The device of claim 1, wherein the substrate includes a first end and a second end, the first hardware interface disposed that the first end, the device further comprising a second hardware interface coupled at the second end, the second hardware interface including:

third contacts disposed on the first side of the substrate; and fourth contacts disposed on the second side of the substrate.

4. The device of claim 3, wherein the third contacts are each coupled via the first side to a respective one of the first interconnects, and wherein the second contacts are each coupled via the second side to a respective one of the second interconnects.

5. The device of claim 1, wherein the device is a flexible flat cable.

6. The device of claim 1, the first hardware interface further comprising a shield structure extending across first contacts.

7. The device of claim 1, wherein the first side and the second side form a recess, and wherein the first hardware interface is disposed in the recess.

8. The device of claim 1, wherein, while the substrate is coupled to the other hardware interface, the first contacts to impart a pressure in a first direction and the second contact to impart a pressure in a second direction opposite to the first direction.

9. A method comprising:

disposing first contacts of a first hardware interface on a first side of a substrate, wherein the substrate is one of a flexible substrate and a printed circuit board, the disposing the first contacts including positioning respective ends of the first contacts each to extend past an edge of the first side;

coupling the first contacts via the first side each to a respective one of first interconnects extending in the substrate, the coupling the first contacts including, for each of the first contacts:

forming a corresponding solder joint at the first side and at the contact, wherein any region of the contact by which the contact is secured to the substrate is a region disposed on the first side;

disposing second contacts of the first hardware interface on a second side of the substrate, wherein the second side is opposite the first side, the disposing the second contacts including positioning respective ends of the second contacts each to extend past an edge of the second side; and coupling the second contacts via the second side each to a respective one of second interconnects extending in the substrate, the coupling the second contacts including, for each of the second contacts:

forming a corresponding solder joint at the second side and at the contact, wherein any region of the contact by which the contact is secured to the substrate is a region disposed on the second side.

10. The method of claim 9, wherein, for each of the first contacts, the contact is coupled to the first side only via the corresponding solder joint, wherein for each of the second contacts, the contact is coupled to the second side only via the corresponding solder joint.

11. The method of claim 9, wherein the substrate includes a first end and a second end, wherein the disposing the first contacts on the first side includes disposing the first contacts at the first end, wherein the disposing the second contacts on the second side includes disposing the second contacts at the first end, the method further comprising:

disposing third contacts of a second hardware interface on the first side; and disposing fourth contacts of the second hardware interface on the second side.

12. The method of claim 11, further comprising:

coupling the third contacts via the first side each to a respective one of the first interconnects; and coupling the fourth contacts via the second side each to a respective one of the second interconnects.

13. The method of claim 9, further comprising coupling a shield structure to the substrate, the shield structure extending across first contacts.

14. The method of claim 9, wherein the first side and the second side form a recess, and wherein disposing the first contacts includes disposing the first contacts in the recess.

15. A system comprising:

a first circuit device including:

a substrate having disposed therein first interconnects and second interconnects, wherein the substrate is one of a flexible substrate and a printed circuit board; and a first hardware interface including:

first contacts disposed on a first side of the substrate, the first contacts each coupled via a corresponding solder joint at the first side to a respective one of the first interconnects, wherein the first contacts each extend past an edge of the first side and wherein, for each of the first contacts, any region of the contact by which the contact is secured to the substrate is a region disposed on the first side; and second contacts disposed on a second side of the substrate, the second side opposite the first side, the second contacts each coupled via a corresponding solder joint at the second side to a respective one of the second interconnects, wherein the second contacts each extend past an edge of the second side and wherein, for each of the second contacts, any region of the contact by which the contact is secured to the substrate is a region disposed on the second side; and a first printed circuit board (PCB) including a second hardware interface coupled to the first circuit device via the first hardware interface.

16. The system of claim 15, wherein the first hardware interface is disposed that a first end of the first circuit device, wherein the first circuit device further comprises a third hardware interface coupled at a second end of the first circuit device, the third hardware interface including:

third contacts disposed on the first side of the substrate; and fourth contacts disposed on the second side of the substrate.

17. The system of claim 16, further comprising a second PCB including a fourth hardware interface coupled to the first circuit device via the third hardware interface.

18. The system of claim 15, wherein, for each of the first contacts, the contact is coupled to the first side only via the corresponding solder joint, wherein for each of the second contacts, the contact is coupled to the second side only via the corresponding solder joint.

* * * * *